United States Patent [19]

Stearns, IV

[11] Patent Number: 5,031,560

[45] Date of Patent: Jul. 16, 1991

[54] SAIL CONSTRUCTION

[76] Inventor: Richard I. Stearns, IV, 1029 Elmwood Ave., Wilmette, Ill. 60091

[21] Appl. No.: 486,693

[22] Filed: Mar. 1, 1990

[51] Int. Cl.[5] ..... B63H 9/04

[52] U.S. Cl. ..... 114/103

[58] Field of Search ..... 114/102–115, 114/39.1, 39.2; 244/145, 152, 201, 204, 213

[56] References Cited

U.S. PATENT DOCUMENTS 585,226 6/1897 Pope ..... 114/103

3,776,170 12/1973 Slemmons ..... 244/145

FOREIGN PATENT DOCUMENTS 2481225 10/1981 France ..... 114/103

7906386 2/1981 Netherlands ..... 114/103

*Primary Examiner*—Jesûs D. Sotelo

*Attorney, Agent, or Firm*—Quarles & Brady

[57] ABSTRACT

A panel construction for bleeding high pressure air from the windward side of a sail to the leeward side of the sail to improve air flow over the leeward side and thereby reduce the heeling component and enhance the thrust component of the aerodynamic force developed by the sail.

4 Claims, 3 Drawing Sheets

PRIOR ART MAINSAIL

NEW MAINSAIL

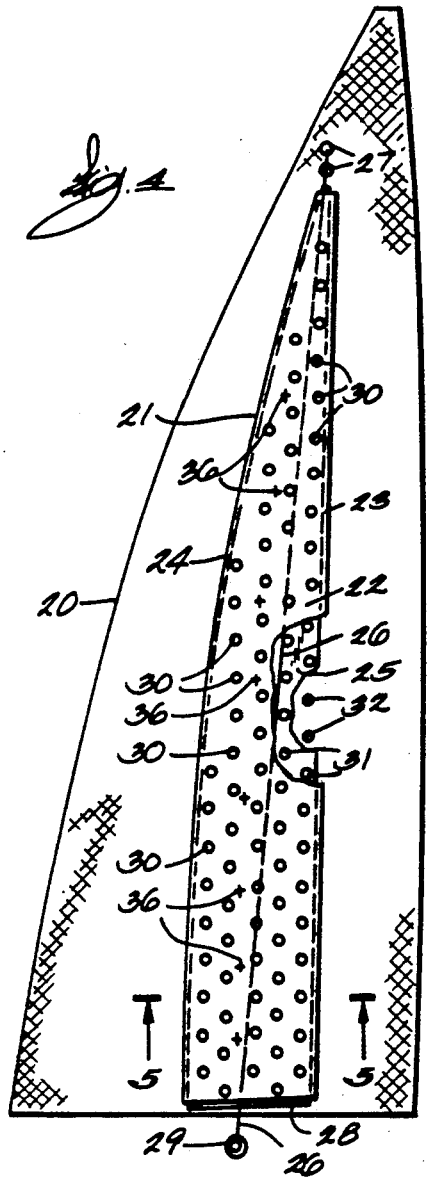
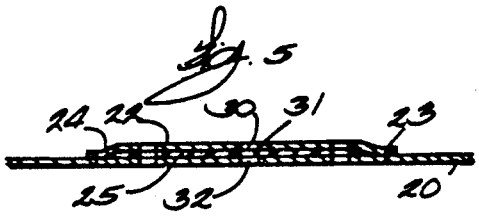
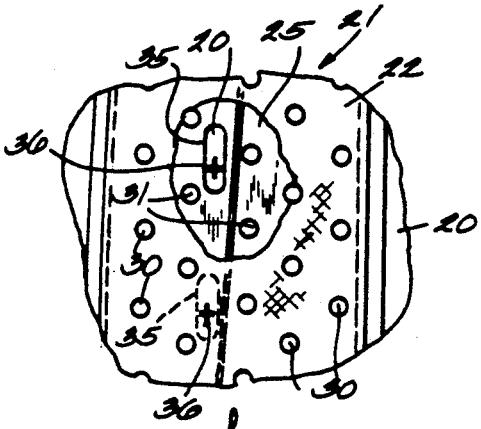
Fig. 6
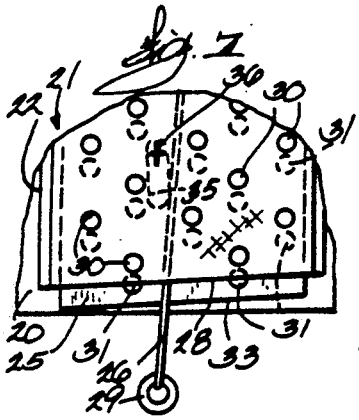
FIRST POSITION
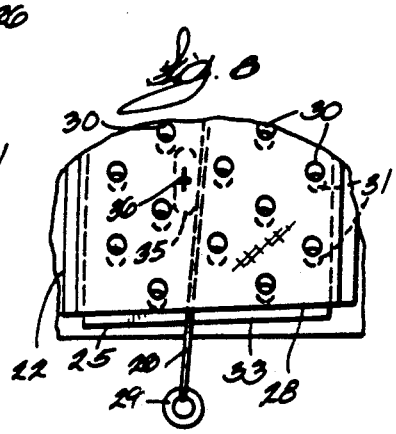
INTERMEDIATE POSITION
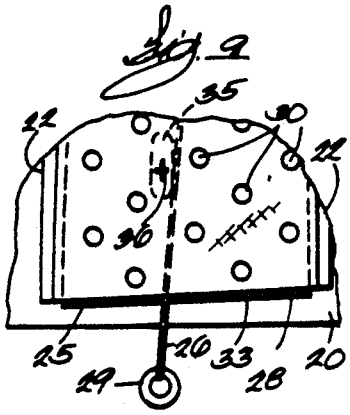
SECOND POSITION

SAIL CONSTRUCTION

FIELD OF THE INVENTION

The present invention relates to a new construction for sails that enables a sailor to modify the flow of air about the sail, more particularly to control the flow of air along the leeward side of a sail.

BACKGROUND ART

The sail of a boat at an angle of incidence to the wind develops low pressure along its leeward side and high pressure along its windward side by reason of the airfoil shape of the sail. This in turn establishes circulation of air about the sail, or a bound vortex, that generates lift and drag forces, which also can be resolved into a thrust component that moves the boat forward and a heel component directed perpendicular to the boat. Equal and opposite hydrodynamic forces are generated by the underwater foils of the boat, i.e., keel or centerboard and rudder, acting at an angle of incidence, or leeway angle, to the flow of water about their surfaces. With an increase in windspeed, several adverse regimes develop wherein the heeling force increases at a greater rate than the forward thrust component of the increased sail force. The first is in the range of moderate to fresh winds, such as windspeeds in the range of about 10 to 20 knots, for example, when the air flow about the leeward side of the sail becomes increasingly turbulent and the sail produces a reduced thrust component but an increased heel component. The second adverse regime is in the range of strong winds and above, such as windspeeds of about 20 knots and higher, in which the heel component increases still further so as to cause an excessive amount of heel whereby the underwater foils work less efficiently and boat slips sideways. In both regimes, the lift developed by the sail increases with the increasing wind strength, but the drag component increases at a faster rate, the resulting effect of which is that the forward thrust component is reduced.

The prior art does not have an effective way of handling the deleterious effect of the turbulent air flow of the first regime in a manner that will maximize boat performance; the sailor, therefore, is not able to realize the full potential of the increased lift, i.e. obtaining a greater measure of forward thrust with its attendant enhancement of boatspeed. The prior art, however, has several techniques of dealing with the strong wind conditions of the second regime set out above, all of which involve shortening sail area. In the case of the typical sloop rigged sailboat, these techniques include reefing the mainsail or changing or furling the jib. The mainsail is most often reefed by a slab reefing system that results in shortening its luff length to reduce sail area; another system involves furling the mainsail inside the mast, but this is in limited use at the present time. With respect to headsails, the technique most often used by racing boats is to change to successively smaller jibs as the windspeed increases. Many cruising sailboats now use a roller furling jib system by which a jib is rolled about a headstay having swivels at its top and bottom ends which enables a jib to be rolled into a progressively smaller size as the wind increases.

The foregoing sail shortening techniques have various disadvantages. Reefing the mainsail results in a poor airfoil shape as compared to the shape built into the full sized main. Slab reefing requires several people to execute the method, and the boat must be sailed in an inefficient condition during the maneuver. Roller furling the main inside the mast also results in an inefficient airfoil shape and has the additional disadvantage of requiring a large mast and associated equipment that results in substantial expense. The jib roller reefing systems also degrade the sail shape as the jib is rolled about the headstay, and the boat is limited to using one jib as it is impractical to change a jib that is rigged for roller furling. Although jib roller furling gear is of moderate expense, it is subject to breakdown or malfunction. Also, a jib must be specially constructed for roller furling and a special sail must be obtained if the system is to be retrofitted to a boat. All of these sail shortening techniques cause extra wear of the sail. Changing to smaller jibs requires several people to take one sail off and hoist another, and skilled people are needed to perform the maneuver in view of the risk involved when working on the bow of a boat in strong wind and rough sea conditions, which is further exacerbated when changing jibs at night.

One of the principal objects of my present invention is to provide a new sail construction that obviates the disadvantages of the prior art sail shortening systems described above. Another principal objective of my invention is to provide a sail construction that also improves the flow of air about a sail in moderate to fresh wind conditions. Still further main objectives are to provide a sail construction with the foregoing capabilities that can be built into a new sail, and also to provide an embodiment thereof that can be retrofitted to an existing sail. These and other advantages and objectives of the invention will become apparent and explained in the detailed description which follows.

SUMMARY OF THE INVENTION

My present invention provides a sail, which can be either a mainsail or a jib; an exterior panel attached to a surface of the sail; a shutter panel between the exterior panel and the sail; apertures formed through the sail the exterior panel and shutter panel; and means to move the shutter panel between a first position in which the apertures are fully closed and a second position in which the apertures are fully open, and also to move the shutter panel to positions intermediate the first and second positions. This new construction enables a sailor to bleed high pressure air from the windward side of the sail to the leeward side of the sail; further, the adjustability of the shutter panel provides a sailor with control of the extent to which this takes place.

DESCRIPTION OF THE DRAWINGS

The full and enabling description of presently-preferred embodiments of the invention that is presented below is made by reference to the accompanying drawings, in which:

FIG. 4 is an enlarged side view, with a portion broken away, of the mainsail of FIG. 3 of the invention;

FIG. 5 is a transverse sectional view of the mainsail of FIG. 4;

FIG. 6 is a side view of a portion of the mainsail of FIG. 4;

FIG. 7 is a side view of a lower portion of the mainsail of FIG. 4 illustrating the shutter panel of the construction of the present invention in its first position;

FIG. 8 is a view similar to FIG. 7 illustrating the shutter panel in an intermediate position;

FIG. 9 is a view similar to FIG. 7 illustrating the shutter panel in its second position;

DESCRIPTION OF PRESENTLY PREFERRED EMBODIMENTS

Figure 1:
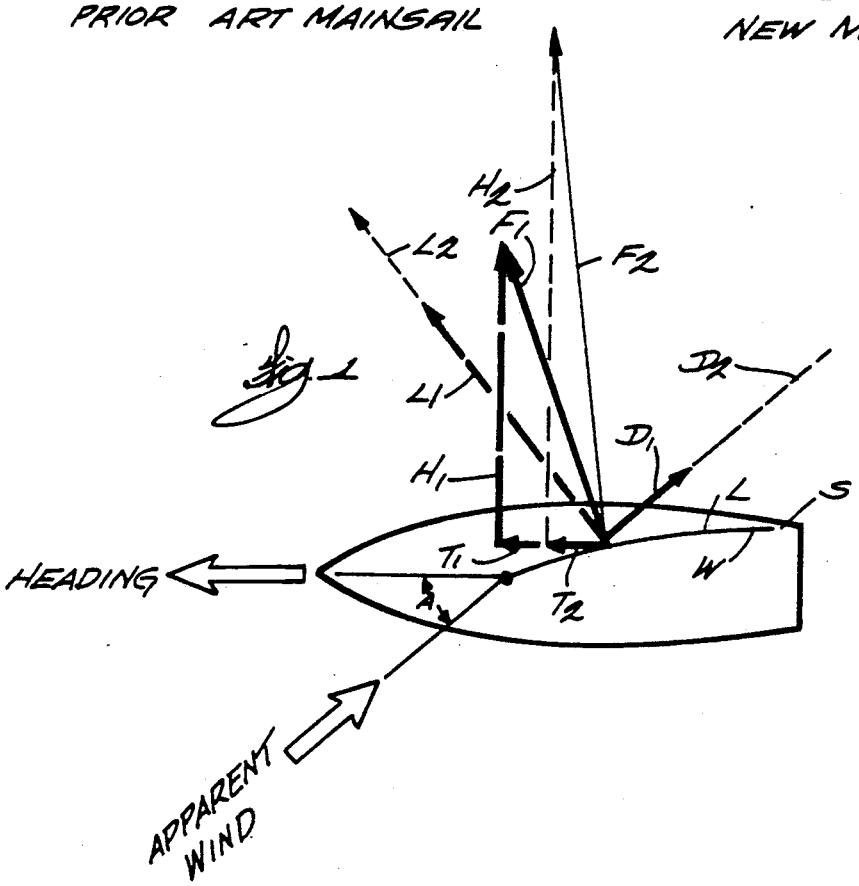
FIG. 1 is a vector diagram illustrating forces developed by a sail acting as an airfoil.

(a) FIG. 1

FIG. 1 is a vector diagram illustrating the forces developed by a sail acting as an airfoil when sailing on a close hauled course at an angle A of about 30° between the heading of the boat and the apparent wind; the effect of leeway is ignored in the schematic of FIG. 1.

The sail S develops high pressure along its windward side W and low pressure along its leeward side L. This results in a series of forces distributed along the leeward side of the sail that produces lift represented by vector $L_1$ which is perpendicular to the apparent wind and drag represented by vector $D_1$ which is parallel to the apparent wind. There are several theories as to the manner in which a sail generates these forces, the most generally accepted theory being that they result from the circulation of air from the high pressure around the low pressure side of the sail, thereby creating a bound vortex. The lift and drag vectors can be represented by a single vector $F_1$ acting at the center of effort of the sail that represent the total aerodynamic force developed by the sail.

The aerodynamic forces developed by the sail also can be resolved into components parallel and perpendicular to the heading of the boat. The component affecting the speed of the boat is the shown by thrust vector $T_1$ in FIG. 1 that is parallel to the heading of the boat. The component perpendicular to the boat is shown by vector $H_1$ which represents the heeling force generated by the sail.

As the windspeed increases, the lift and drag forces developed by the sail both increase as represented by vectors $L_2$ and $D_2$ in FIG. 1 and produce a larger total sail force $F_2$. Drag $D_2$ increases more relative to $D_1$ than lift $L_2$ increases relative to $L_1$ which condition also is represented by FIG. 1. Moreover, the new heeling force $H_2$ is now larger than the heeling force $H_1$, but the new thrust component shown as vector $T_2$ in FIG. 1, is less than the thrust $T_1$. The windspeed condition represented by vector $F_2$ is typical of the condition that develops in strong windspeeds and above, such as windspeeds in the range of 20 knots and higher. The effect of these higher windspeeds on boat performance is that the thrust component responsible for boatspeed is reduced and a greater heeling force is generated. Both of these factors, reduced thrust component and increased heeling force, adversely affect boat performance. The prior art techniques for handling this situation are describe in Section (b) below.

Figure 2:
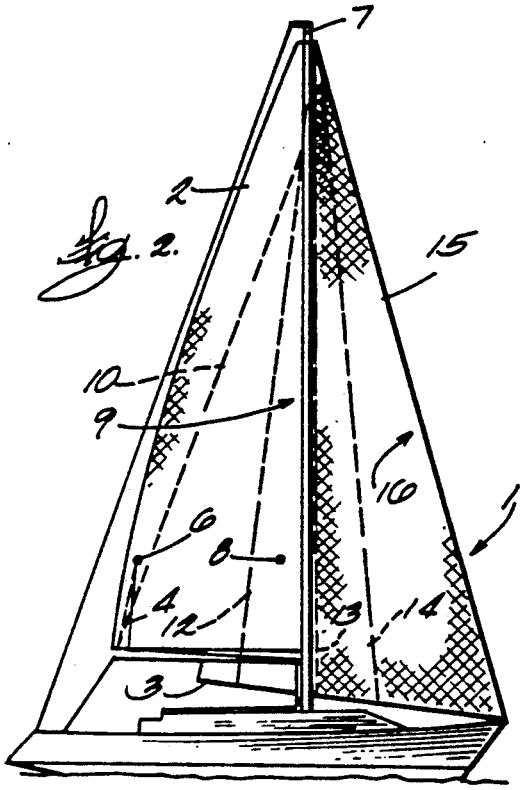
FIG. 2 is a side view of a sailboat with a typical prior art mainsail.

(b) Prior Art, FIG. 2

FIG. 2 illustrates a sailboat 1 with a typical sloop rig comprising a mainsail 2 and a jib 3. The mainsail may be made of panels of coated polyester fabric such as Dacron®, laminates of polyester fabric and polyester film such as Mylar®, laminates of Kevlar® fabric and polyester film, or composites of two or more of the foregoing materials. Mylar®, Mylar® and Kevlar® are registered trademarks of du Pont.) The mainsail includes a slab reefing system, one of the prior art techniques for reducing the area of a sail when the wind is strong enough to overpower a boat. The reefing system includes a reefing line 4 that is deadened near the aft end of boom 5, led vertically upwards and through a reefing cringle 6 along the leech of the sail, back down to the boom and then forward along the boom to the mast 7. The reefing line is then generally led aft along the cabin top to a winch, not shown, for hauling in line 4 when the sail is to be reefed. In order to reef the prior art mainsail 2, the sail is luffed and the main halyard is lowered until a cringle 8 at the luff 9 of the sail, which is at the same height above boom 5 as reefing cringle 6, is secured to a hook at the front end of the boom, reefing line 4 is pulled in to bring cringle 6 down to the boom, and the mainsail is retrimmed. The size of sail 2 is then reduced by the area of the section of the sail between the boom and cringles 6 and 8. The approximate area of the reefed mainsail 2 is illustrated by dashed line 10 in FIG. 1.

Most sailboats that employ the slab reefing system for the mainsail will have two or three reefing lines rigged, each with a reefing cringle at a different height along the leech of the sail, so that additional increments of the area of the sail can be reefed as the windspeed increases further. As noted in the Background Art description, another prior art system for reefing a mainsail is to furl its luff 9 inside mast 7; however, this system is little used at the present time due to its expense, such as requiring a new mast and considerable amount of gear inside the mast to furl the luff, and it is not a system that can be easily retrofitted to an existing boat.

It is further typical for sailboats to reduce the area of the headsails as the windspeed increases. One system is to change to successively smaller jibs for this purpose, which is the system used mostly by racing sailboats. The boat in FIG. 2 is illustrated with a full size No. 1 jib or genoa 3 in solid line. As the wind increases, the jibs may be changed to a No. 2, No. 3 or No. 4 jib, each progressively smaller, which are illustrated by dashed lines 12, 13 and 14, respectively, in FIG. 2. For extreme wind conditions, a storm jib, not shown, is often used. Another system for reducing headsail area is a jib roller furling system that utilizes a single jib, generally of the size of a No. 1 jib 3 that is secured to headstay 15 which has swivel connections at its upper end at the top of the mast and its bottom end at the bow of the boat. Jib 3 can then be reduced in area by operating a furling line, not shown, so that its luff 16 will be wound about headstay 15. The jib furling systems enable a single jib to be carried on the boat and furled as necessary in accordance with the windspeed, hence their popularity on cruising boats.

The sail shortening or reefing systems of the prior art described have various disadvantages, many of which are described in the Background Art section of this description. Another disadvantage of the slab reefing system of mainsail 2 is that it will be noted that the sail can be reefed in only discrete sections, i.e. the area of the sail between the boom and the cringles for a reefing line. The same disadvantage is apparent with the system of changing to successively smaller jibs, such as changing through jibs 3 and 12–14. One of the objectives of my invention is to provide a new and useful system that has the same effect as reefing or furling a sail, or changing to a smaller size headsail, without the attendant disadvantages of the prior art techniques.

(c) New Sail Construction of the Invention, FIGS. 3–10

Figure 3:
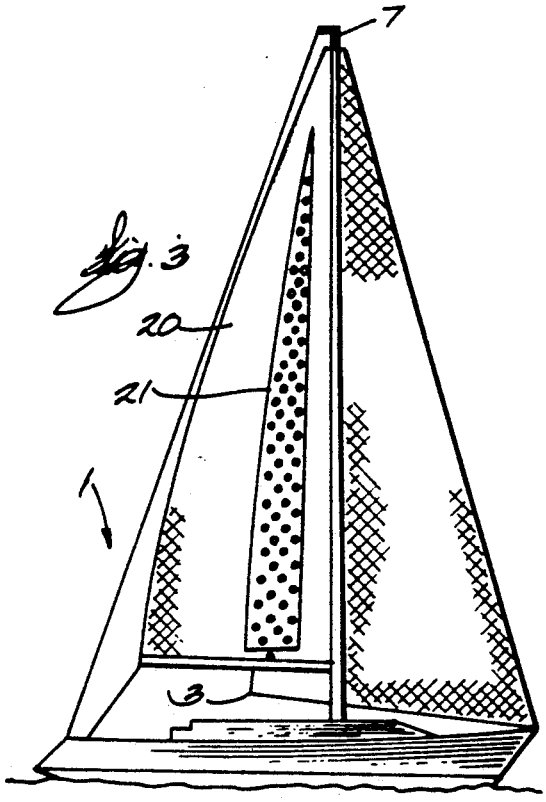
FIG. 3 is a side view of a sailboat with a mainsail constructed in accordance with the present invention.

FIG. 3 illustrates sailboat 1 with a mainsail 20 that includes a panel system 21 constructed in accordance with the present invention. Panel system 21 is illustrated in detail as to construction and operation in FIGS. 4–9.

Turning first to FIGS. 4 and 5, panel system 21 includes an exterior panel 22 that is secured to a surface of sail 20 along its fore and aft edges 23 and 24, respectively, such as by means of a suitable adhesive or stitching. Exterior panel 22 can be made of any of the materials typically used in sail construction, such as previously described. A shutter panel 25 is positioned between exterior panel 22 and the surface of sail 20 to which panel 22 is attached. Shutter panel 25 is to be movable with respect to sail 20 and exterior panel 22, so that it is not fastened to either element. For this purpose, a control line 26 is secured to the top portion of shutter panel 25 and led through two spaced grommets 27 in the sail 20, from which line 26 extends downwardly along panel system 21, preferably between panels 22 and 25, and has a bottom portion extending beyond bottom edge 28 of the exterior panel. A pull ring 29 or similar device can be attached to the lower end of line 26, which will be located near or along the boom of the sailboat, or at such other position from which it will be conveniently accessible for actuation as set out later in this description. Shutter panel 25 is most usefully made of a sheet of polyester film, such as Mylar®, so that it will slide easily relative to the sail and exterior panel 22.

Both the exterior panel 22 and the shutter panel 25 can be very thin so as to not adversely affect the flow of air across the surface of the sail to which the panel system is attached. Thus, panels 22 and 25 can each be as thin as about 0.001" to 0.004", depending on the size of the sail on which the panel system is installed. The panel system can be installed along the middle section of the sail at the area of maximum camber or along the forward or aft section of the sail; also, two panel systems can be installed on a sail.

Further in accordance with the present invention, a series of spaced apertures 30 are defined through exterior panel 22; preferably, apertures 30 are arranged in staggered spaced vertical columns and spaced horizontal rows as shown in FIG. 4. Apertures 31 are similarly formed through shutter panel 25, and apertures 32 are similarly formed through the surface of sail 20 underneath exterior panel 22. Apertures 30 of exterior panel 22 are aligned and registered with apertures 32 of sail 20. Apertures 31 of shutter panel 25 are arranged in the same pattern as apertures 30 and 32. Apertures 30, 31 and 32 are shown as all being of the same diameter in the exemplary embodiment.

Referring now to FIG. 6, but see also FIG. 4, shutter panel 25 includes a series of spaced oval openings 35, two of which are shown in FIG. 6. Exterior panel 22 is further joined to mainsail 20 by stitching 36 between panel 22 and sail 20 that extends through an oval opening 35. As seen in FIG. 4, a row of stitchings 36 extend from near the bottom of the panel system 21 to near its top. The row of stitchings 36 function to reduce or prevent bubbling of the various layers of the panel system.

The operation of panel system 21 is illustrated in FIGS. 7–9.

Shutter panel 25 is illustrated in its first or closed position in FIG. 7, wherein shutter panel 25 is in its lowermost position relative to exterior panel 22 in the exemplary embodiment. In this first position, apertures 31 of shutter panel 25 are not aligned with apertures 30 and 32 of panel 22 and sail 20, respectively. Instead, the solid portions of shutter panel 25 between its apertures 31 are positioned between apertures 30 and 32 so as to block the flow of air through apertures 30 and 32.

FIG. 9 illustrates shutter panel 25 in its second position, or fully opened condition, wherein the panel has been raised by pulling on control line 26 a sufficient distance that its apertures 31 are fully aligned with apertures 30 of exterior panel 22 and apertures 32 of mainsail 20. This second position of the shutter panel provides for the maximum flow of high pressure air from the windward side of the sail through the aligned apertures 30, 31 and 32 to the leeward of the sail. The second position of shutter panel 25 will be employed to affect the maximum reefed condition of the mainsail, as explained more fully below. FIG. 5 illustrates the second position of shutter panel 25 and the manner in which apertures 30, 31 and 32 are fully aligned to provide passages or channels for the flow of air from one side of the sail to the other.

Shutter panel 25 also can be adjusted by actuation of line 26 to all positions intermediate between the first and second positions wherein the apertures 31 of the shutter panel are partly overlapped, with aligned apertures 30 and 32, but apertures 30 and 32 are partially closed by the solid sections of shutter panel 25 between its apertures 31. This condition will provide for some flow of air from the high pressure side to the low pressure side of the sail. An intermediate position of this type is illustrated in FIG. 8, wherein line 26 has been pulled an amount sufficient such that a portion of each aperture 31 of the shutter panel is aligned with apertures 30 and 32 of the exterior panel 22 and mainsail 20, respectively, so as to permit a controlled flow of high pressure air from the windward side to the leeward side of the sail. The shutter panel can be adjusted to numerous positions between the first position and the second position so as to provide control over the extent to which high pressure air is allowed to flow or bleed to the leeward side of the sail. The intermediate positions of the shutter panel are used to enhance the flow of air along the leeward side of the sail in some wind conditions and to provide a lesser degree of reefing of the sail than that of its second position at other windspeeds.

As shown in FIGS. 7–9, the bottom edge 33 of shutter panel 25 extends beyond bottom edge 28 of exterior panel 22 in the various positions of the shutter panel. This arrangement enables the bottom edge portion of shutter panel 25 to be grasped manually to move panel 25 downwards when desired, line 26 being used to move panel 25 upwards.

Figure 10:
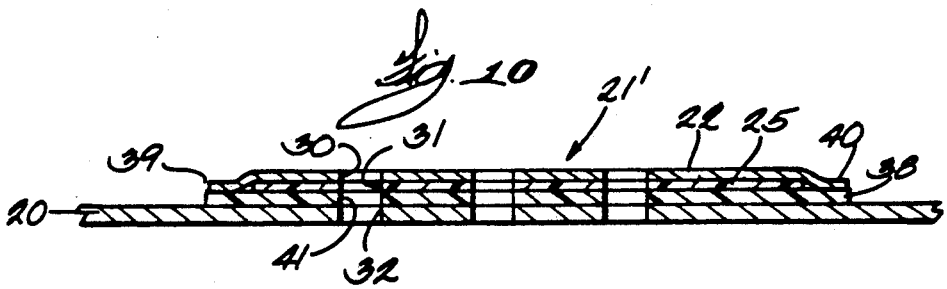
FIG. 10 is a transverse sectional view of a second embodiment of the invention.

FIG. 10 illustrates a second panel system 21′ constructed in accordance with my present invention. Elements that are the same or similar as corresponding elements of panel system 21 are indicated by the same reference numerals used in the preceding description.

Panel system 21' includes an exterior panel 22 and a shutter panel 25. Further, however, panel system 21' includes an inner panel 38 that can be made of the same types of materials employed for panels 22 and 25. Inner panel 38 is coextensive with exterior panel 22 and panels 22 and 38 are joined together along their contacting edge portions 39 and 40. Panel system 21' is especially useful for retrofitting an existing sail. It is made as an assembly comprising panels 22, 25 and 38 and then attached to a surface of a sail 20 along edge portions 39 and 40. After panel system 21' is attached to sail 20, apertures 41 are defined in inner panel 38 concurrently with formation of apertures 30, 31 and 32 in panel 22, panel 25 and sail 20 respectively. Operation of panel system 21' is the same of that of panel system 21 previously described.

Example

A developmental prototype panel system 21 was installed on a mainsail that was 40.25 feet on the luff and 13.75 feet on the foot for a Tartan 10 sailboat. The sail was made of 6½ ounce coated Dacron ® sailcloth. Panel system 21 was 32 feet long, about 3 feet wide near the foot of the main sail, and tapered to about 6 inches wide near the head of the mainsail. Exterior panel 22 was made of sailcloth identified in the trade as 2 mil Mylar ® consisting of a 1.5 mil thick layer of Mylar ® and a 0.5 mil thick layer of Mylar ® with a fabric reinforcement layer laminated between the two layers of Mylar ®. Shutter panel 25 was made of 3 ounce coated Dacron ® sailcloth. Apertures 30, 31 and 32 were simultaneously cut through the exterior panel 22, shutter panel 25 and sail 20, respectively, as illustrated above, that were 2 inches in diameter and located on 5.5 inch centers in rows of four apertures alternating with rows of three apertures.

Tests were conducted sailing the boat close hauled at windspeeds of 10 knots and 30 knots. At the 10 knot windspeed, with the apertures in panel system 21 closed, the boat had 12° of heel. With the apertures of panel system 21 opened to their second position, the boat had 9° of heel, windward helm was reduced, and the boat was able to point 3° closer to the wind while maintaining boatspeed. At the windspeed of 30 knots, the boat heeled at about 25 to 30° with the apertures of the panel system closed, and displayed a similar reduction in heel angle with the apertures open although it was difficult to measure accurately in view of the wind and sea conditions; however, the data revealed that the boat was able to point 5° closer to the wind and there was a one-half knot increase in boatspeed.

Figure 11:
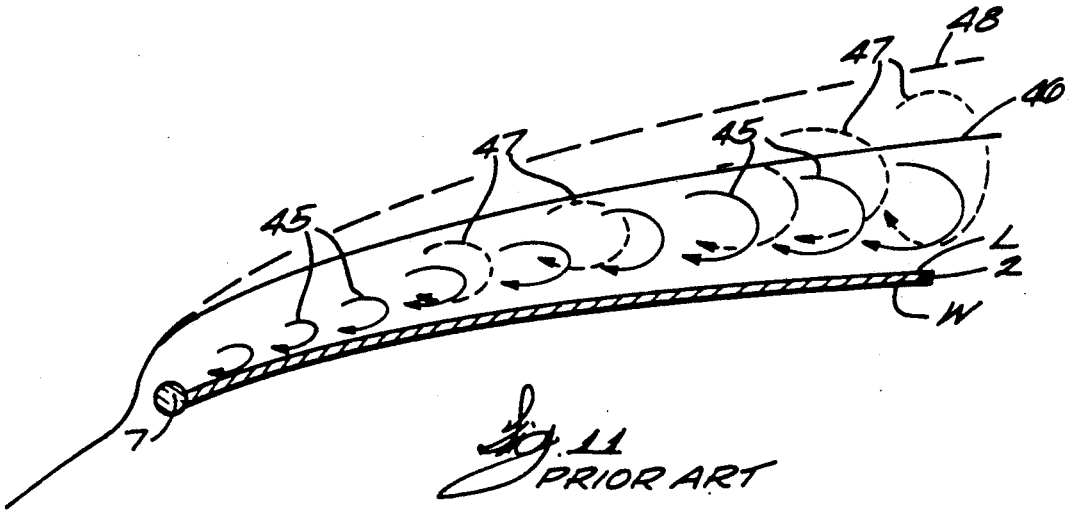
Fig. 11 PRIOR ART
FIG. 11 is a schematic view representing the flow of air about a prior art sail in fresh and strong wind conditions.
Figure 12:
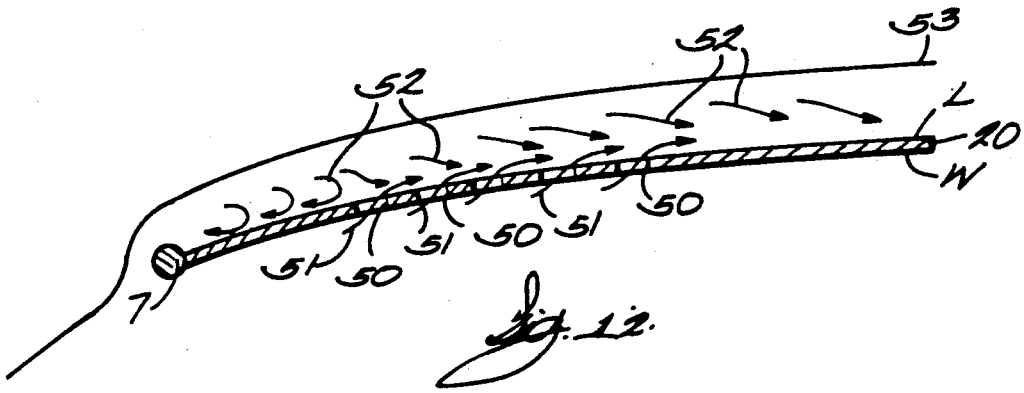
FIG. 12 is a schematic view representing the flow of air about the mainsail of FIG. 4 with the shutter panel of the construction of the present invention in its second position.

(d) Discussion, FIGS. 11 and 12

The panel system of the present invention functions to improve the flow of air along the leeward side of the sail in both moderate and strong wind conditions by actuation of the shutter panel to an intermediate position or its second position. This part of the description, made by reference to the schematic drawings of FIGS. 11 and 12, sets forth my present understanding as to the manner in which the new panel system operates, although I do not wish to be bound by any specific theory.

FIG. 11 schematically represents the flow of air about prior art mainsail 1 in both moderate and strong wind conditions. Back eddies 45, shown in solid line in FIG. 11 to represent air flow in moderate wind conditions, develop along the leeward surface L of the sail and enlarge as the wind flows aft along the sail. The eddies 45 are mainly responsible for the drag force generated by the sail. The wind begins to detach or separate from the leeward side L of the sail as indicated by air streamline 46. The air flow in strong wind conditions is illustrated by back eddies 47 shown in dotted line in FIG. 11, which are represented as being larger than eddies 45 developed during fresh wind conditions. Also, there is greater separation of the air flow from the leeward side of the sail in strong wind conditions, as indicated by streamline 48 in dashed line in FIG. 11. Under both conditions illustrated in FIG. 11, as the wind approaches the leech of the mainsail, two factors cause the air to detach or the flow to stop over the mainsail: one is that the pressure differential between the windward side W and leeward side L of the sail get so great so as to cause a stall and the second is that the back eddies get so large that the air loses attachment to the sail to thereby result in inefficient air flow. The end result is that there is a reduction of the thrust component of the aerodynamic force that is responsible for boatspeed and a concomitant increase in the heel component of the sail force. When the heeling force gets excessive, the sail will have to be reefed with one of the prior art systems described in section (b) to alleviate this condition.

FIG. 12 is a schematic view representing mainsail 20 incorporating panel system 21 of the present invention wherein the shutter panel 25 is in its second position so that apertures 31 of the shutter panel are completely aligned with apertures 30 and 32 of the exterior panel 22 and mainsail 20, respectively; this arrangement of apertures 30–32 is illustrated schematically by channels 50 in FIG. 12. High pressure air from the windward side W of mainsail 20 flows through channels 50 and along the leeward side L of the sail as shown by air flow arrows 51. The introduction of air along the leeward side of the sail reduces the size of back eddies 52 or prevents them from enlarging as compared to eddies 45 and 47 of FIG. 11. Further, the introduction of air along leeward side L is believed to straighten eddies 52 as depicted in the drawing. Air flow is in a more attached condition as shown by airstream line 53. Another effect of the flow of air through the channels 50 is that the pressure differential between the windward side W and leeward L of the sail is reduced. It is my belief that reduction of the pressure differential reduces the heeling component of the total force generated by the sail. Further, the reduction in size and straightening of back eddies along the leeward surface of the sail functions to reduce the drag developed by the sail, and it is believed that the drag can be reduced without reducing lift if the proper amount of air is vented from the windward side to the leeward side of the sail. The net effect of the second position of the shutter panel 25 is that the drag and heeling forces are reduced, whereas the thrust component available to enhance boatspeed will be increased in comparison to, for example, the condition described previously with reference to FIG. 1 regarding vectors $L_2$ and $D_2$. Mainsail 20 is in a reefed condition with the shutter panel in its second position of FIG. 12. The heel component of the sail force is reduced significantly so that the boat will not be in an overpowered condition, eve though the area of the sail has not been reduced in the manner of the prior art reefing techniques described in section (b). Also, the boat will be more maneuverable than a boat with a reefed sail as described in section (b) in view of the fact that boatspeed will be enhanced due to the increase in the thrust component of the sail force. This in turn means that a sailboat will be better able to beat to windward in heavy wind conditions, so that the panel system 21 of the invention provides an important safety factor in addition to eliminating the need for the reefing systems of the prior art.

Similar effects occur when the shutter panel is moved to an intermediate position in moderate relative windspeeds such as about 10 to 20 knots. The principle objective of an intermediate position of the shutter panel is to smooth the flow of air along the leeward side of the sail 20 and reduce or straighten the back eddies. By reducing the development of back eddies, i.e. reducing the turbulence of the air flow along the leeward side of the sail, the drag developed by the sail is reduced while the total force and lift remain the same; this in turn results in increasing the thrust component of the total sail force. The sail 20 is thereby able to function in a more efficient manner wherein a greater proportion of the aerodynamic sail force is available for improving boatspeed.

The foregoing has described novel panel constructions for bleeding high pressure air from the windward side of a sail to the leeward side and thereby improve air flow over the leeward side of the sail; it is believed this provides a means for reducing heeling component and enhancing the thrust component of the aerodynamic force developed by a sail. The full and enabling description presented above is made by reference to specific embodiments of the invention. Various modifications of the exemplary embodiments, however, are possible. The new panel constructions of the invention have been described by reference to a mainsail; the panel constructions also can be incorporated on headsails, including jibs and spinnakers. The panel constructions can be used on both large and small boats. The size of the panel construction can be varied, depending on the end result desired; similarly, the size and spacing of the apertures formed in the several elements of the panel construction can be varied in accordance with the selected objective. The new panel constructions provide a means for improving air flow over the leeward side of a sail when the shutter panel is in an intermediate or its second position; also, of importance when sailing in light and moderate winds, the panel constructions do not deleteriously affect the sail's performance when the shutter panel is in its first or fully closed first position with the apertures fully closed. The embodiments described above are illustrative and it is expected that the foregoing and other changes and modifications to the specific constructions illustrated and described can be made by those of ordinary skill in the art that will be remain within the true spirit and scope of this invention.

I claim:

1. A panel construction for a sailing comprising, in combination:

an exterior panel attached to a surface of the sail and extending from near the foot of the sail to near the head of the sail; a movable shutter panel substantially coextensive in size with the exterior panel positioned between the exterior panel and the portion of the sail under the exterior panel; a plurality of spaced apertures extending through the exterior panel, the shutter panel and the portion of the sail under the exterior panel, the exterior panel, shutter panel and sail each including solid portions between said apertures therein; and the shutter panel being movable between a first position in which the solid portions of the shutter panel between said apertures therein are located between the apertures in the exterior panel and the sail, a second position in which the apertures in the exterior panel, shutter panel and sail are aligned and fully open, and intermediate positions in which the apertures are partially closed by solid portions of the shutter panel between said apertures therein, whereby high pressure air from the windward side of the sail flows through the apertures when the shutter panel is in its second position or an intermediate position.

2. A panel construction according to claim 1, wherein the apertures are arranged in rows and columns along the panel construction.

3. A panel construction according to claim 1 or 2, further including control line means attached to the shutter panel for moving the shutter panel between its first, second and intermediate positions.

4. A panel construction according to claim 1 or 2 wherein: the shutter panel further includes a series of spaced oval openings, and the exterior panel is joined to a portion of the sail under the exterior panel through said oval openings.

* * * * *